US007475446B1

(12) United States Patent
He

(10) Patent No.: US 7,475,446 B1
(45) Date of Patent: Jan. 13, 2009

(54) BRIDGE SYSTEM USING PREFABRICATED DECK UNITS WITH EXTERNAL TENSIONED STRUCTURAL ELEMENTS

(76) Inventor: Yidong He, 865 Buttonwood Cir., Naperville, IL (US) 60540

( * ) Notice: Subject to any disclaimer, the term of this patent is extended or adjusted under 35 U.S.C. 154(b) by 524 days.

(21) Appl. No.: 11/251,299

(22) Filed: Oct. 15, 2005

Related U.S. Application Data

(60) Provisional application No. 60/619,424, filed on Oct. 16, 2004.

(51) Int. Cl.
*E01D 19/02* (2006.01)
*E01D 21/00* (2006.01)

(52) U.S. Cl. ..... 14/77.1; 14/73; 14/74.5; 52/223.7

(58) Field of Classification Search ..... 14/77.1, 14/74.5, 73
See application file for complete search history.

(56) References Cited

U.S. PATENT DOCUMENTS 890,769 A * 6/1908 Hewett ..... 52/174
3,295,276 A * 1/1967 Stanley ..... 52/174
4,604,841 A * 8/1986 Barnoff et al. ..... 52/174
4,625,354 A * 12/1986 Richard ..... 14/73
4,710,994 A * 12/1987 Kishida et al. ..... 14/77.1
4,972,537 A * 11/1990 Slaw, Sr. ..... 14/77.1
5,097,558 A * 3/1992 Accorsi et al. ..... 14/73
5,437,072 A * 8/1995 Dinis et al. ..... 14/73
5,457,839 A 10/1995 Csagoly
5,577,284 A * 11/1996 Muller ..... 14/73
5,771,518 A 6/1998 Roberts
5,802,652 A * 9/1998 Smith ..... 14/73
5,850,653 A * 12/1998 Mufti ..... 14/73
6,470,524 B1 * 10/2002 Mairantz ..... 14/77.1
6,568,139 B2 5/2003 Bot
6,574,818 B1 * 6/2003 Matiere ..... 14/77.1
6,668,412 B1 12/2003 Tadros et al.

OTHER PUBLICATIONS http://www.fhwa.dot.gov/bridge/prefab/decks.htm (technical information from the Federal Highway Administration).
Issa, et al, Full Depth Precast and Precast, Prestressed Concrete Bridge Deck Panels, PCI Journal, Jan.-Feb. 1995, pp. 59-80.
He, et al, Rapid Bridge Deck construction / Replacement Methods—A Precast Deck Solution, Proceeding of International Bridge Conference, 2001, Pittsburgh, PA.

* cited by examiner

*Primary Examiner*—Raymond W Addie

(57) ABSTRACT

A bridge system comprised of prefabricated deck units spaced along longitudinal load-carrying members. Tensioned structural elements are external to a plurality of the prefabricated deck units and produce longitudinal axial compression in these units. The tensioned structural elements can be deviated relative to the horizontal plane of the prefabricated deck units, subsequently enhancing the load-carrying capacity of the longitudinal load-carrying members. Leveling devices that permit relative motion between the longitudinal load-carrying members and the prefabricated deck units are provided. The leveling devices allow for the tensioned structural elements to provide longitudinal compression to the prefabricated deck units independent of the longitudinal load-carrying members.

16 Claims, 12 Drawing Sheets

BRIDGE SYSTEM USING PREFABRICATED DECK UNITS WITH EXTERNAL TENSIONED STRUCTURAL ELEMENTS

CROSS-REFERENCE TO RELATED APPLICATIONS

This application claims the benefit of U.S. Provisional Application No. 60/619,424, filed Oct. 16, 2004 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to the design and construction of bridges, specifically to bridges with prefabricated deck units.

2. Prior Art

Cast-in-place concrete decks are the most commonly used type of bridge deck. However, the cast-in-place construction of concrete decks requires the placement of formwork, field placement of reinforcement, and field placement of concrete. This is a time consuming process and requires intensive field labor.

Full-depth precast concrete deck units that are used for bridge decks have been developed to overcome the disadvantages of cast-in-place concrete decks as listed above. Use of such deck units allows for the deck concrete and reinforcement to be placed in a controlled environment, improving the quality of the deck. Since the units are prefabricated, they can be delivered to a site and erected quickly.

Bridges using full-depth precast concrete deck units typically consist of a plurality of longitudinally spaced concrete units supported by longitudinal load-carrying members. These members are usually a single girder or multiple girders or beams. This member or members can be comprised of various materials including steel, concrete or composite material.

When no longitudinal post-tensioning is used in conjunction with a precast concrete deck, the use of cast-in-place joints between precast deck units is required so that reinforcement present the deck units can be lapped, whereby providing continuity at the joints. The cast-in-place joint requires extensive fieldwork and the uncompressed joint typically exhibits long term maintenance and durability problems.

An improvement that has been made to precast concrete decks is to introduce longitudinal post-tensioning. The post-tensioning can provide a compression force across the deck joints, whereby improving the durability of cast-in-place joints. The introduction of longitudinal post-tensioning also facilitates the use of match-cast joints in conjunction with precast concrete decks. However, all current precast bridge deck construction employs internal post-tensioning, wherein post-tensioning ducts or sheaths are embedded inside the concrete deck. The current practice of using internal post-tensioning has several disadvantages, including:

(a) the extensive ductwork in the precast concrete deck units requires the ducts to be placed very accurately so that they will align with the ducts in the adjacent unit;

(b) duct coupling is required at the joints between the precast concrete deck units. If a duct is not coupled properly, jointing materials can leak into the duct and cause duct blockage. This can result in significant construction delays and quality of construction problems;

(c) the internal post-tensioning is vulnerable to corrosion, particularly in climates where deicing chemicals are used. These chemicals can penetrate through the concrete and corrode the post-tensioning steel, especially at locations where the post-tensioning ducts are coupled;

(d) the longitudinal post-tensioning used in the precast concrete deck units, as used in current practice, only provides compression to the precast concrete deck units without contributing to the load-carrying capacity of the longitudinal load-carrying member or members on which the precast concrete units rest;

(e) internal post-tensioning is very difficult to inspect and often requires an indirect inspection method such as non-destructive testing (NDT);

(f) internal post-tensioning cannot be replaced in the event of corrosion. Therefore, the only option is to replace the entire deck system, which can result in significant construction and user delay cost;

OBJECTS AND ADVANTAGES

Accordingly, several objects and advantages of the present invention are to provide a construction system that:

(a) facilitates rapid construction of a bridge, wherein increasingly tight construction schedules and/or site constraints can be accommodated;

(b) allows for post-tensioning to be placed external to the bridge deck, whereby significantly simplifying post-tensioning placement and replacement, increasing the ease of and providing flexibility in deck placement, increasing the ease of inspection and eliminating the need for post-tensioning duct coupling at deck unit joints;

(c) allows for post-tensioning to not only subject the deck to compression, but also allows to increase the overall load resistance of the bridge, whereby significantly reducing the amount of material required in the longitudinal load carrying members;

(d) produces a bridge that facilitates inspection and maintenance;

(e) produces a bridge that has enhanced durability;

(f) does not require special equipment to be used beyond the equipment already in use in current bridge construction practice;

(g) provides all other objects and advantages while facilitating the use of longitudinal load-carrying members of various lengths, various cross-sections and various materials, whereby providing bridge owners, designers and contractors flexibility to achieve the best overall economy in their choice of longitudinal load-carrying members;

Further objects and advantages will become apparent from a consideration of the ensuing description and drawings.

SUMMARY

In accordance with the present invention a bridge construction system comprises prefabricated deck units spaced along longitudinal load-carrying members with tensioned structural elements external to a plurality of these prefabricated deck units that produce axial compression in these units.

DRAWINGS

Figures

DRAWINGS

Reference Numerals

Figure 1:
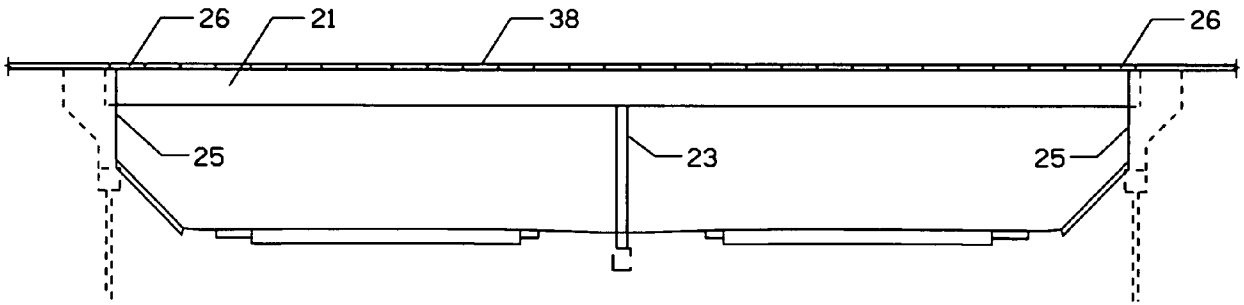
FIG. 1 shows the elevation view of an example bridge used to describe the present invention.

20 post-tensioning anchorage
21 concrete girder
22 post-tensioning duct
23 pier
24 duct coupler
25 abutment
26 anchor unit
27 shim
28 void
30 haunch
32 girder top surface
36 lap unit
38 typical unit
40 match-cast joint
42 erection post-tensioning bar
44 erection post-tensioning duct
46 intermediate diaphragm
48 pier diaphragm
50 shear stud
52 post-tensioning tendon
54 girder post-tensioning tendon
56 anchor unit duct
58 shear stud base
60 lap unit post-tensioning anchorage
62 tendon deviator
64 abutment diaphragm
66 girder end block

DETAILED DESCRIPTION

FIGS. 1 Through 7—Preferred Embodiment

A preferred embodiment of the bridge construction system of the present invention is illustrated in FIGS. 1 through 8 in the context of a two-span bridge, hereinafter referred to as "example bridge". The example bridge has two abutments 25 and a pier 23 acting as substructure units. The preferred embodiment of the bridge construction system is comprised of concrete girders 21 acting as longitudinal load-carrying members, precast concrete deck units acting as prefabricated deck units and post-tensioning tendons 52 acting as tensioned structural elements. The precast concrete deck units can be constructed using long or short line match-casting or without match-casting.

However, those features comprising the bridge construction system mentioned in the preferred embodiment and the substructure and span arrangement mentioned above can have various embodiments not mentioned in the preferred embodiment, as discussed in detail hereinafter and as will become apparent from a consideration of the ensuing description and drawings.

Concrete girders 21 are placed on and supported by abutments 25 and pier 23. Girder post-tensioning tendons 54 are anchored in abutment diaphragms 64 of concrete girders 21, but not anchored in precast concrete deck units, are not discussed hereinafter for clarity, as this post-tensioning is not directly part of the present invention but may be used in conjunction with it. One familiar with the art should carefully evaluate the longitudinal load-carrying members chosen so as to achieve the best overall economy.

Concrete girders 21 are of the U-beam type, but may be of any suitable structural shape, such as I-beams, bulb-T beams, box girders, etc. On top of concrete girders 21, a plurality of leveling devices is placed that allow for relative longitudinal motion between concrete girders 21 and the precast concrete deck units. In the preferred embodiment, the leveling devices are comprised of shims 27, however leveling bolts or other devices that can provide support for the deck and allow for relative longitudinal motion between concrete girders 21 and the precast concrete deck units can be used. As will be evident from the description hereinafter, this allowance for relative motion will allow for the precast concrete deck units to be compressed by the tensioning of post-tensioning tendons 52. Shims 27 may be of steel, plastic, elastomeric materials, teflon-based or teflon-impregnated materials, etc.

Figure 2:
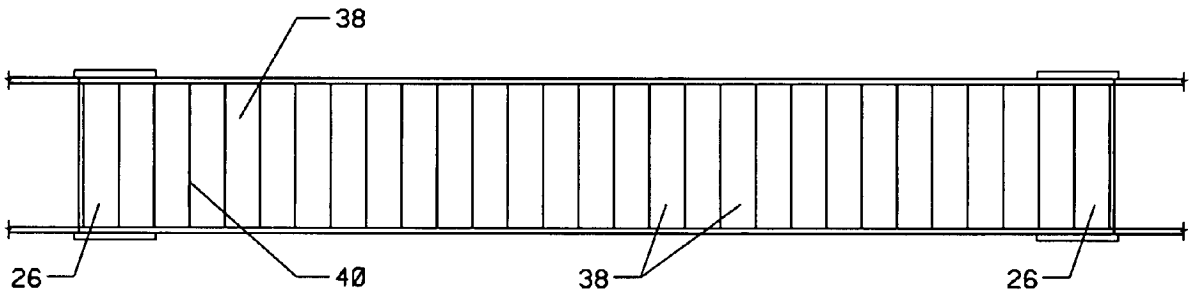
FIG. 2 shows the plan view of the example bridge.
Figure 3:
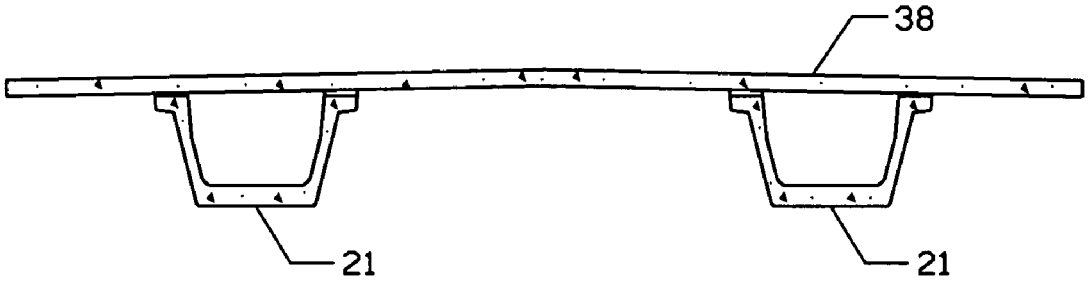
FIG. 3 shows the general cross section of the example bridge.
Figure 4:
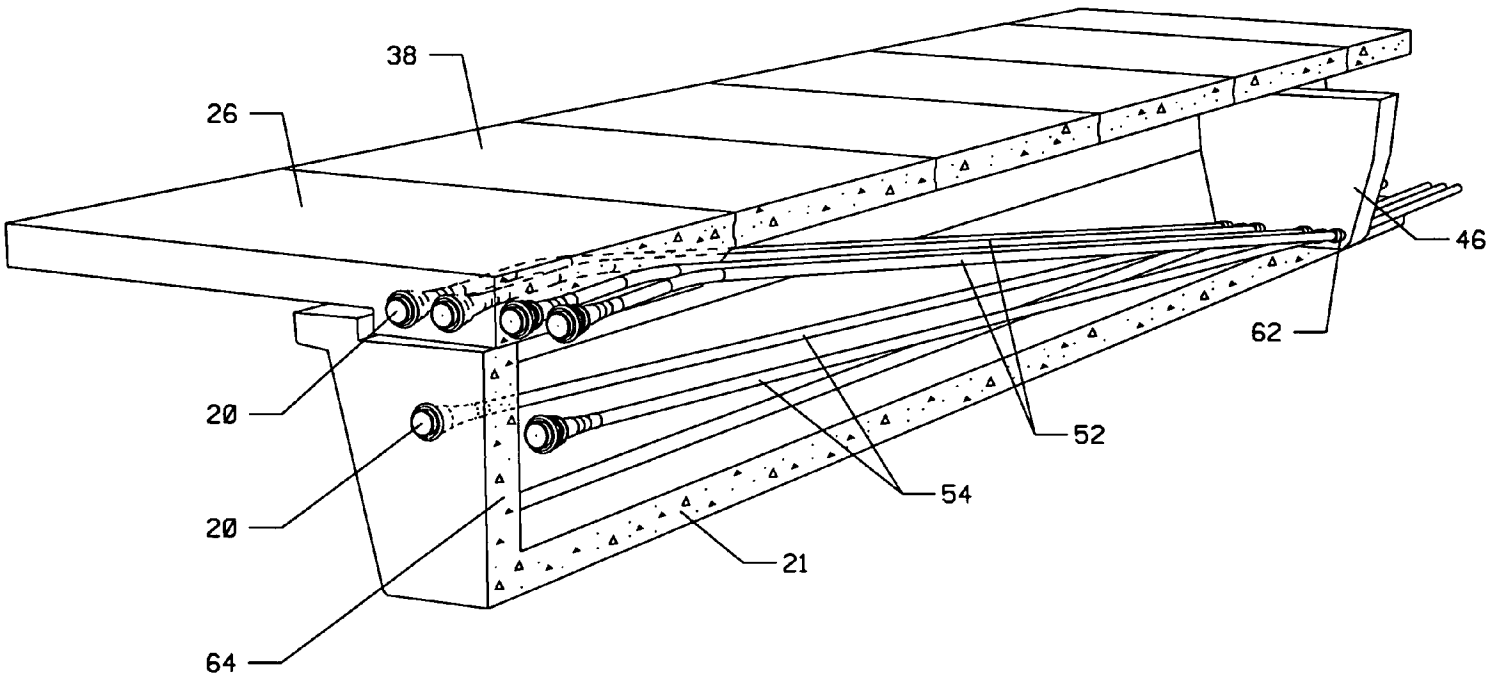
FIG. 4 shows the partial isometric view of the bridge system near an end of the bridge.

A plurality of the precast concrete deck units are thickened and provided with post-tensioning anchorages 52 and associated ducts 56 and are hereinafter referred to as "anchor units". Anchor units 26 act as a means to transfer tension in post-tensioning tendons 52 into longitudinal axial compression in precast concrete deck units situated between pairs of anchor units 26. Anchor units 26 are placed at the two longitudinal ends of the bridge in the example bridge as shown in FIG. 2.

Anchor units 26 contain post-tensioning anchorages 20 and embedded post-tensioning ducts 56, which exit on the underside of anchor units 26. If required, the post-tensioning anchorages 20 and ducts 56 in anchor units 26 can be detailed to allow for the replacement of post-tensioning tendons 52 in the future.

A plurality of voids 28, similar to those used in conventional precast deck placement, are provided in anchor units 26 above girder top surfaces 32 of concrete girders 21 to allow for mechanical connection of anchor units 26 to concrete girders 21 by means of shear developers. The voids 28 will be grouted after the stressing of post-tensioning tendons 52, as hereinafter described in detail. Haunches 30 will also be grouted at this point. Voids 28 and shear developers shall be detailed to allow relative motion between precast concrete deck units and concrete girders 21 during the precast concrete deck unit erection process, as hereinafter described. In the preferred embodiment, shear developers are shear studs 50 and shear stud base 58. Shear stud base 58 is comprised of steel plates embedded in concrete girders 21. Shear studs 50 are welded to shear stud base 58 after precast concrete deck units are in place. Other types of shear developers can be used, such as reinforced bars protruding from top surfaces 32 or other devices that can transfer the horizontal shear force between the precast concrete deck units and concrete girders 21 after voids 28 and haunches 30 are grouted.

Figure 5:
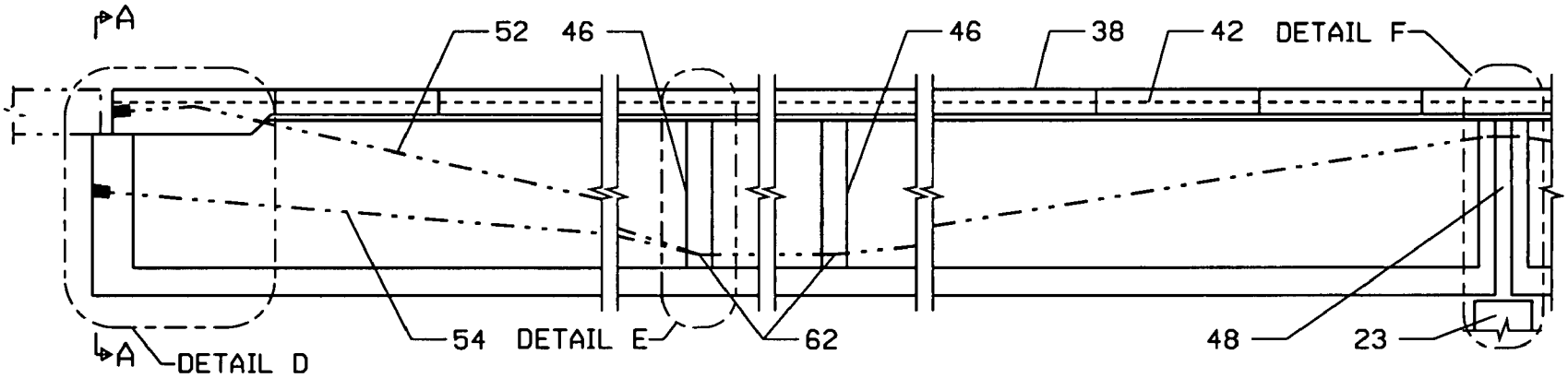
FIG. 5 shows the profile of longitudinal post-tensioning tendons.
Figure 5A:
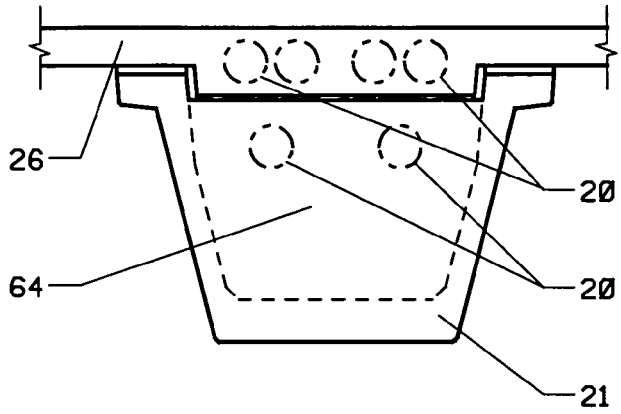
FIG. 5A shows the post-tensioning anchor arrangement at the end of the bridge.
Figure 5D:
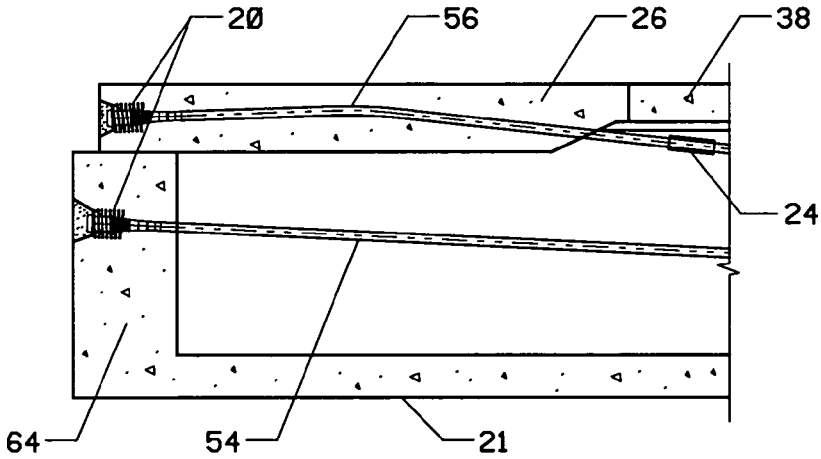
FIG. 5D shows the post-tensioning profile at the end of the bridge.
Figure 5E:
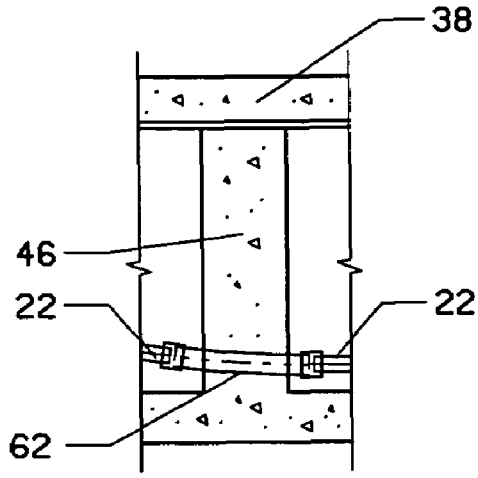
FIG. 5E shows the deviation detail at an interior diaphragm.
Figure 5F:
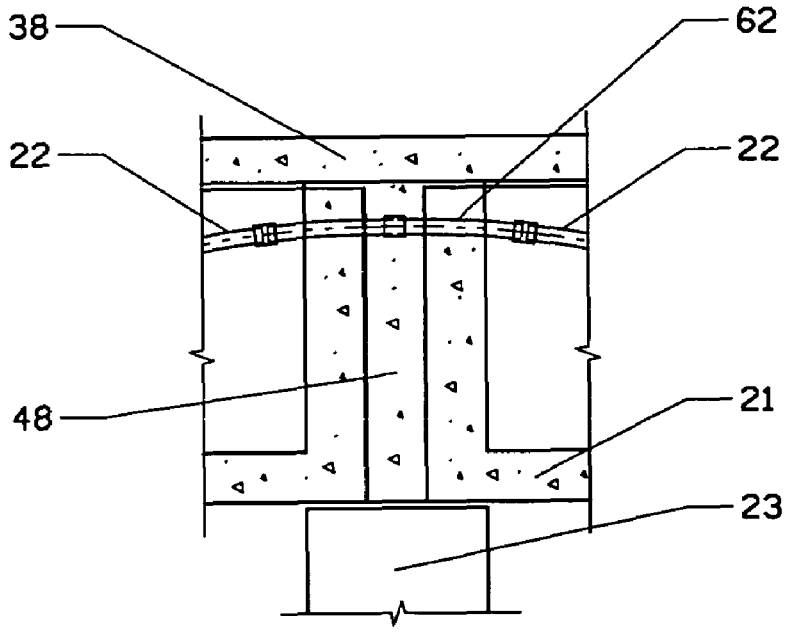
FIG. 5F shows the deviation detail at the pier.

In the preferred embodiment, post-tensioning ducts 22 and tendons 52 are deviated vertically down relative to anchor units 26, therefore the locations of the post-tensioning anchorages 20, anchor unit post-tensioning deviation points, and the locations of shims 27 supporting anchor units 26 on concrete girders 21, as shown in FIG. 5D, have to be carefully balanced to avoid overturning of anchor units 26. Holddown devices can be provided in a plurality of voids 28 to further prevent uplift of anchor units 26 upon stressing of post-tensioning tendons 52.

Figure 8:
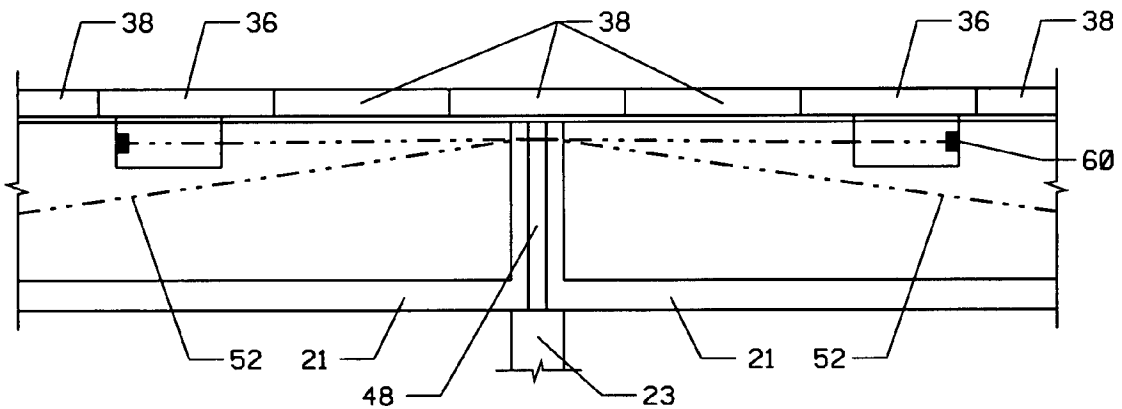
FIG. 8 shows a profile view of lapped longitudinal post-tensioning tendons.

For situations where material, fabrication or construction constraints or high stress losses dictate the use of post-tensioning tendons 52 that cannot connect between anchor units 26, precast concrete deck units are provided with post-tensioning ducts 22 and anchorages 20 so as to allow for the lapping of post-tensioning tendons 52 as shown in FIG. 8. Such precast concrete deck units are hereinafter referred to as "lap units". Lap units 36 would typically be located near substructure units where the most desirable post-tensioning tendon location is near the top of concrete girders 21. Post-tensioning tendons 52 are anchored below the depth of typical units 38, as hereinafter defined, so as not to inhibit the durability of the deck. Care should be taken in the detailing of lap units 36 to ensure adequate access to post-tensioning anchorages 60 and to minimize any overturning moments. Holddown devices can be supplied to resist these overturning moments. While an example of a lap unit is illustrated in FIG. 8, no lap unit is used in the example bridge, as is shown in FIG. 5.

Precast concrete deck units that are not provided with post-tensioning anchorages 52 or lap unit post-tensioning anchorages 60 are hereinafter referred to as "typical units". A plurality of typical units 38 are placed longitudinally along concrete girders 21, on top of shims 27, adjacent to one another and between the two anchor units 26. When typical units 38 are located on top of pier 23, blockouts in the typical units can be provided to allow concrete to be poured for pier diaphragm 48.

Figure 6J:
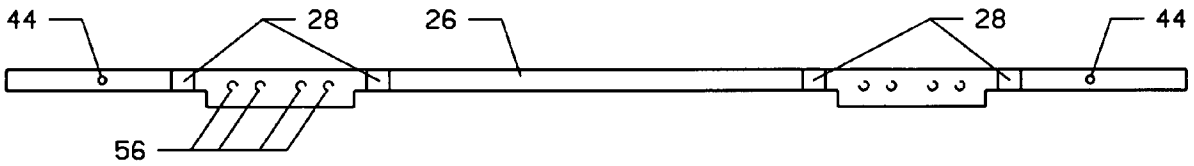
FIG. 6J shows a transverse cross-section of an anchor unit.
Figure 6:
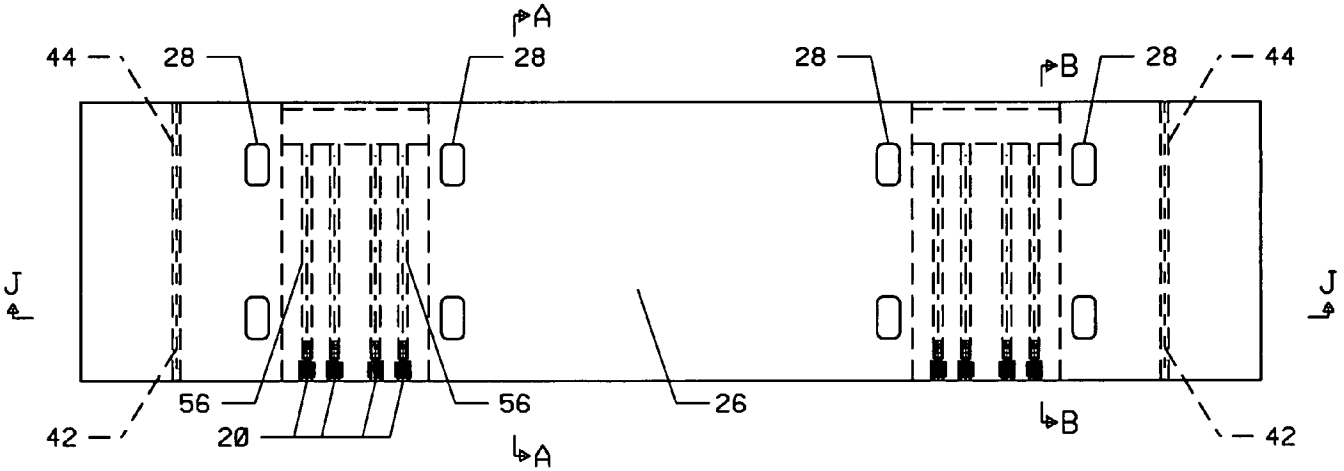
FIG. 6 shows the plan view of an anchor unit.
Figure 6A:
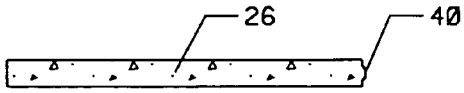
FIG. 6A shows a typical section through an anchor unit.
Figure 7B:
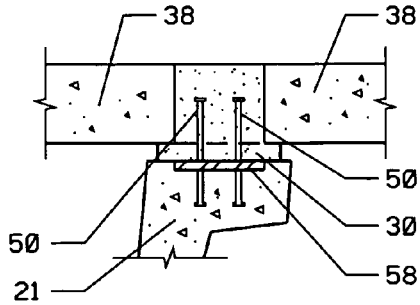
FIG. 7B shows the detail of the haunch, shear developers and precast concrete deck unit.
Figure 6B:
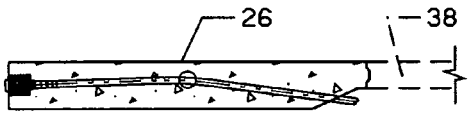
FIG. 6B shows a section through an anchor unit at a longitudinal post-tensioning anchorage.
Figure 7E:
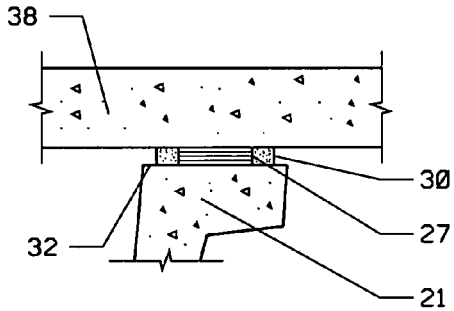
FIG. 7E shows the detail of a set of shims.
Figure 7A:
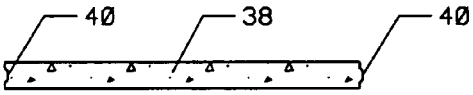
FIG. 7A shows a typical section through a typical unit.
Figure 7C:
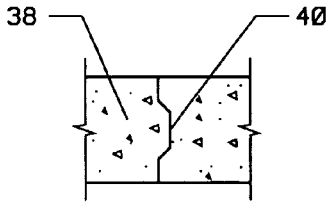
FIG. 7C shows the detail of a match cast joint.
Figure 7D:
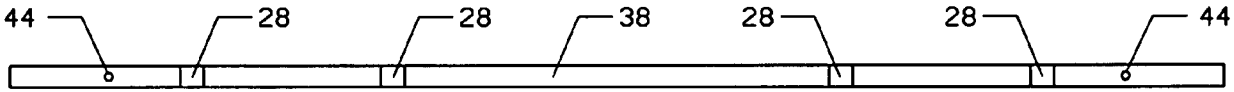
FIG. 7D shows a transverse cross-section of a typical unit.
Figure 7:
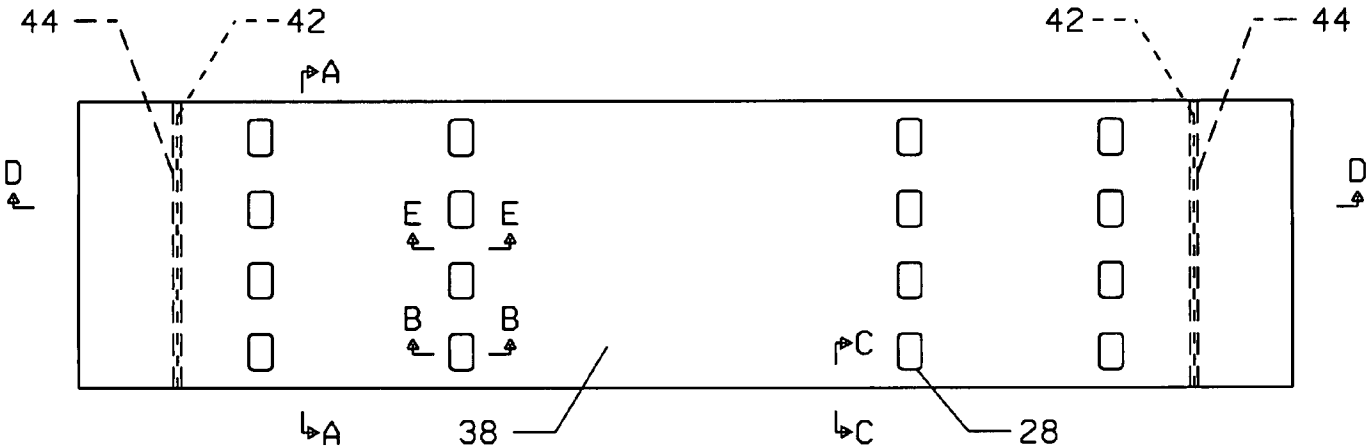
FIG. 7 shows the plan view of a typical unit.

Joints between adjacent precast concrete deck units can be of the match-cast type, with or without epoxy, as shown in FIGS. 6A, 7A and 7C, or cast-in-place using concrete, grout or other suitable jointing material. The use of match-cast joints 40 provides reduced erection time and increased quality of joint when compared with cast-in-place joints. However, for long structures or structures with highly variable deck geometries, a minimum amount of cast-in-place joints may be necessary at certain locations to facilitate final deck geometry adjustment.

In the preferred embodiment, match-cast epoxy joints are used. Therefore, provision for the placement of internal erection post-tensioning bars 42 through the inclusion of internal erection post-tensioning ducts 44 is made in typical units 38, anchor units 26 and when used, lap units 36. The provisions made for internal erection post-tensioning bars 42 are not required for embodiments of the present invention that utilize cast-in-place joints between precast concrete deck units. This provision is to allow for the individual precast concrete deck units to be tightened together by the stressing of erection post-tensioning bars 42 prior to the stressing of post-tensioning tendons 52. A minimum number of post-tensioning bars 42 are needed for erection, as the force required to close any gaps between deck units is typically minimal. For all precast concrete deck units, provision is made for the installation and subsequent stressing of erection post-tensioning bars 42 through casting-in erection post-tensioning ducts 44 and providing block-outs for the subsequent placement of erection post-tensioning bar anchorages, and providing adequate access to these anchorages to allow for stressing erection post-tensioning bars 42. Provision is also made for placing grout in erection post-tensioning ducts 44, through the placement of grout tubes or other devices that will allow for grout to be placed through ducts 44.

Erection post-tensioning bars 42 may be high strength steel bars, rods, or other elements or materials capable of withstanding high tensile stresses. Provision is also made for the coupling and grouting of erection post-tensioning ducts 44. The use of erection post-tensioning bars 42 and erection post-tensioning ducts 44 is typical in segmental bridge construction. Internal erection post-tension bars 42 are to be placed concentric to precast concrete deck units. Erection post-tensioning bars 42 can be left in the deck permanently or can be removed after longitudinal post-tensioning tendons 52 are stressed. In either case, grouting of the internal erection post-tensioning ducts 44 will be accomplished after the completion of deck erection.

The use of erection post-tensioning bars 42 and ducts 44 should not be construed to result in the previously stated durability problems to which conventional full-depth segmental decks are prone, nor to limit the durability advantages of the present invention as herein stated. This is so because erection post-tensioning bars 42 are not prescribed to provide the deck compression required for durability, but are provided for temporarily compressing adjacent precast concrete deck units together prior to the stressing of the externally located post-tensioning tendons 52. Therefore, even if corrosion of erection post-tensioning bars 42 were to occur, the overall durability of the bridge deck would be minimally affected.

Post-tensioning tendons 52 are placed external to typical units 38 and are stressed at and anchored in anchor units 26 as shown in FIGS. 5, 5D, 6 and 6B. Post-tensioning tendons 52 may be high strength steel wires, strands, or other elements or materials capable of withstanding high tensile stresses. In the preferred embodiment, post-tensioning tendons 52 are vertically deviated relative to the precast concrete deck units at a plurality of locations along the length of the bridge. Post-tensioning tendons 52 pass through intermediate diaphragms 46. In conjunction with the choice of U-beams for the preferred embodiment, intermediate diaphragms 46 are within concrete girders 21. Alternate embodiments may place intermediate diaphragms between adjacent concrete girders. Vertical deviations of post-tensioning tendons 52 occur at intermediate diaphragms 46 and pier diaphragm 48. Horizontal deviation of tendons 52 may also be required, based on girder geometry.

Alternate embodiments for the present invention are described hereinafter:

(a) The prefabricated deck units can be comprised of any other material that is suitable for supporting loads anticipated to be applied to the deck units, such as composite material, wood, steel-concrete composite units, etc.

(b) The longitudinal load-carrying members can be comprised of any other material or cross-section suitable to support the loads applied to these members such as steel I-girders, precast prestressed concrete I-beams, composite material I-girders, single or multiple box girders of steel or concrete, trusses, wood beams, etc.

Figure 9A:
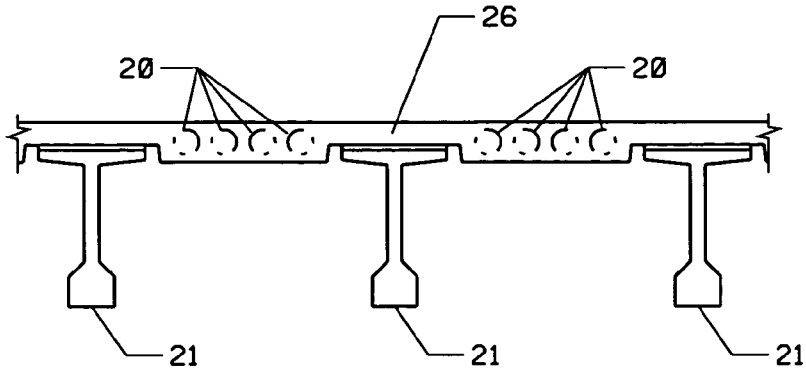
FIG. 9A shows a section through the deck and post-tensioning anchorages when using I-girders as longitudinal load-carrying members.
Figure 9B:
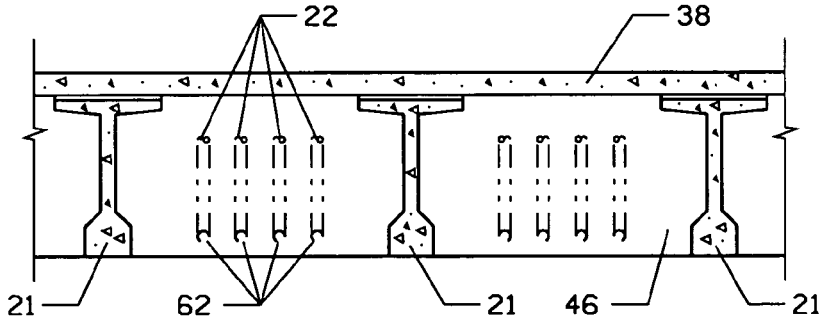
FIG. 9B shows a typical section at intermediate diaphragms when using I-girders as longitudinal load-carrying members.
Figure 10A:
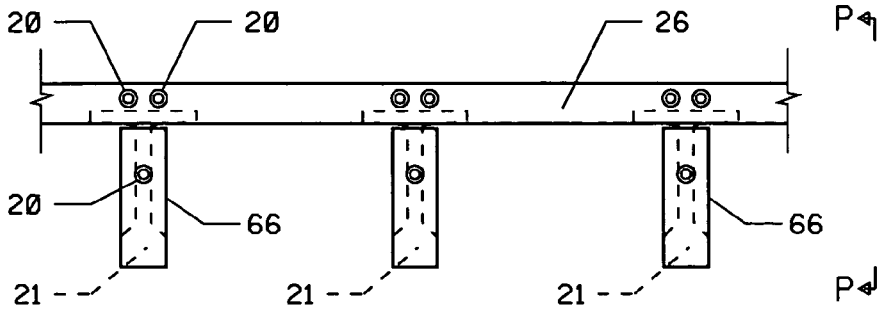
FIG. 10A shows a section through the deck and post-tensioning anchorages when using concrete I-girders as longitudinal load-carrying members with longitudinal post-tensioning external to the precast concrete deck units running internal to the concrete I-girders.
Figure 10B:
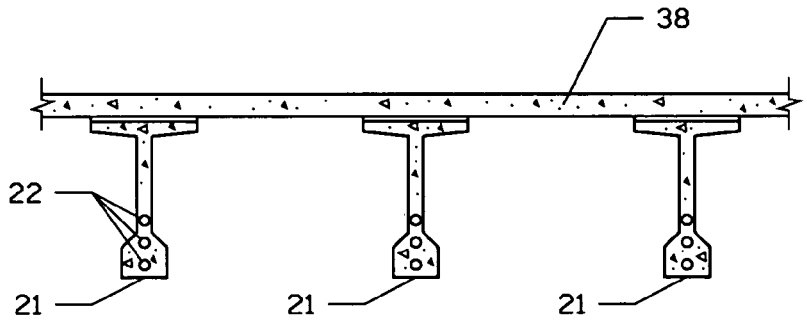
FIG. 10B shows a typical section when using concrete I-girders as longitudinal load-carrying members with longitudinal post-tensioning external to the precast concrete deck units running internal to the concrete I-girders.
Figure 10P:
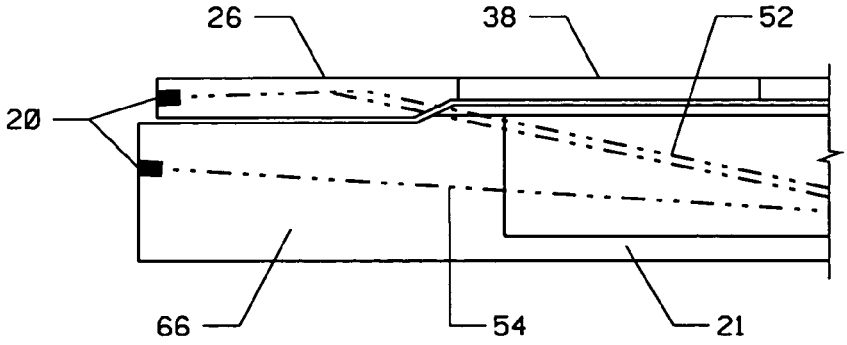
FIG. 10P shows an elevation detail at a bridge end where is post-tensioning is internal to a girder.

(c) Post-tensioning tendons that anchor at the anchor units but are external to the typical units can be placed either internal or external to the section of the longitudinal load-carrying members themselves. Examples of placing the post-tensioning tendons external to the section of the longitudinal load-carrying members are illustrated in the preferred embodiment, in which the post-tensioning runs through the open portion of the U-beam but not through the U-beams' webs themselves, and in FIGS. 9A, 9B, in which the post-tensioning runs between adjacent I-girders. An example of placing the post-tensioning tendons internal to the section of the longitudinal load carrying members is shown in FIGS. 10A, 10B, and 10P. In this arrangement, the post-tensioning ducts are embedded internally to the girder webs after they exit anchor unit 26. Girder post-tensioning tendon 54 is anchored at girder end block 66. Girder end block 66 can also facilitate the transition of post-tensioning duct from deck anchor unit to girder. Girder end block allows the use of oversize ducts so to provide reasonable construction tolerance.

(d) The diaphragms can be comprised of any material and configuration suitable for transferring the deviation force applied by the tensioned structural elements to the adjacent longitudinal load-carrying members, such as concrete or steel diaphragms or cross-frames.

(e) The present invention can be applied to bridges with curved or kinked girder arrangements. With such an arrangement, post-tensioning tendons will be deviated horizontally, following the girder geometry, in addition to the vertical deviation as heretofore described in regard to the example bridge. Additional intermediate diaphragms can be used to provide horizontal deviations as needed. Care should be taken in designing the intermediate diaphragms and deck-to-girder connections to ensure the horizontal deviation force can be safely transferred between the elements.

Operation

The preferred embodiment in the context of the example bridge is illustrated hereinafter.

Abutments 25 and pier 23 are constructed. Concrete girders 21 are fabricated with intermediate diaphragms 46 and shear stud base 58. Intermediate diaphragms 46 are provided with tendon deviators 62. Concrete girders 21 are erected onto abutments 25 and pier 23. A plurality of precast concrete deck units, comprising anchor units 26 and typical units 38 are fabricated at a precast concrete facility and transported to the bridge site.

Anchor units and typical units are fabricated with all post-tensioning ducts 22, voids 28, and erection post-tensioning ducts 44 heretofore described. Anchor units are also fabricated with post-tensioning anchorages 20.

After concrete girders 21 are erected, the girder top elevation is surveyed and the shim thickness at each supporting point will be calculated so as to provide the correct setting elevations for deck units. A plurality of shims 27 is placed on top of the concrete girders. Anchor units 26 are placed at both ends of the bridge on top of shims 27 at these locations.

Post-tensioning ducts 22 running external to typical units 38 are coupled to ducts 56 that are cast in anchor units 26. Sliding duct couplers 24 at a plurality of locations are provided to accommodate the movement between the precast concrete deck units and concrete girders 21. Ducts 56 are deviated vertically in relation to the horizontal plane defined by the final positions of the precast concrete deck units, as hereinafter described, and placed through intermediate diaphragms 46 provided with tendon deviators 62. Provision is also made in the installation of post-tensioning ducts 22 for later flowing grout through these ducts as hereinafter discussed.

Post-tensioning tendons 52 are run through post-tensioning ducts 22 and installed in post-tensioning anchorages 20. In the case of an alternate embodiment in which one or more lap units 36 are required, post-tensioning tendons are also installed in ducts and post-tensioning anchorages 20 in lap units 36.

Typical units 38 are erected, placing the first typical unit adjacent to one anchor unit and applying epoxy to the adjacent faces of the two units. Erection post-tensioning bars 42 are then installed between the first typical unit and the adjacent anchor unit in conjunction with coupling erection post-tensioning ducts 44. Erection post-tensioning bars 42 are stressed until the gap between the adjacent units is sufficiently tight to allow the epoxy to set. This stressing is accomplished by a post-tensioning bar stressing device, such as a post-tensioning bar jack. Subsequent typical units are erected following a similar procedure with two adjacent typical units. This process is continued until all typical units 38 are installed longitudinally along the bridge. Erection post-tensioning bars 42 are installed between the final erected typical unit and adjacent anchor unit and erection post-tensioning ducts 44 are coupled. Epoxy is placed on the adjacent faces of these two units and the erection post-tensioning bars 42 are stressed until the gap between the adjacent units is sufficiently closed.

Post-tensioning tendons 52 running between anchor units are now stressed in what is hereinafter referred to as "Stage 1 Stressing". This stressing is accomplished by a post-tensioning tendon stressing device, such as a post-tensioning tendon jack. Shims 27 allow for relative motion between the precast concrete deck units and concrete girders 21, allowing for longitudinal compression to be transferred from post-tensioning tendons 52 into the precast concrete deck units. Vertical deviation of the post-tensioning tendons 52 allows for the application of vertical forces to concrete girders 21 through intermediate diaphragms 46. These vertical forces significantly increase the load-carrying capacity of concrete girders 21.

After Stage 1 Stressing, voids 28 and haunches 30 are filled with grout, whereby making precast concrete deck units composite with concrete girders 21. Pier diaphragm 48 is poured using concrete, whereby making concrete girder 21 continuous between the two spans.

Post-tensioning tendons 52 are then further stressed in what is hereinafter referred to as "Stage 2 Stressing". Since the precast concrete deck units are now composite with concrete girders 21, Stage 2 Stressing engages the composite section similar to a typical post-tensioned set of girders. Vertical deviation of the post-tensioning tendons 52 allows for the application of increased vertical forces to concrete girders 21 through intermediate diaphragms 46. These increased vertical forces further increase the load-carrying capacity of concrete girders 21. Stage 2 Stressing has the added benefit of applying axial longitudinal compression forces to the composite section, both the precast concrete deck units and concrete girders 21, further increasing the durability and load-carrying capacity of the bridge.

After Stage 2 Stressing, erection post-tensioning ducts 44 and post-tensioning ducts 22 are grouted, and other miscellaneous finishing details typical to bridge construction are accomplished, such as installation of cast-in-place or precast parapets, completion of bridge approaches, etc.

Post-tensioning tendons 52 stressed in Stage 1 will result in different stress distributions in the bridge than those resulting from Stage 2 Stressing. The amount of stressing force in each stage should be evaluated to achieve the most favorable outcome for the bridge. Post-tensioning tendons 52 can be stressed entirely in Stage 1, with no stressing in Stage 2, if desired.

The operational description above is particular to the preferred embodiment of the present invention in the context of the two-span bridge heretofore defined. Alternate materials, member shapes, stressing stages, etc. can be used in employing the bridge construction system of the present invention.

Advantages

The present invention provides a structural system that eliminates many of the drawbacks found in current precast bridge deck construction. Notably, it prevents potential duct conflicts and blockages by reducing the number of coupling locations and providing accessible ducts that are easy to place and align. The durability of the bridge deck and post-tensioning system is doubly enhanced by first, placing the post-tensioning system external to and below the deck, whereby significantly reducing the susceptibility of the post-tensioning tendons to corrosion, and second, providing longitudinal compression in the deck, which greatly reduces cracking and subsequent intrusion of corrosive agents. In addition to the durability benefits, the external post-tensioning provides ease of inspection, and the post-tensioning can be detailed so as to be able to be replaced.

Beyond simply providing a system that eliminates drawbacks in current precast bridge deck construction, the present invention, through the deviation of the post-tensioning tendons herein discussed, also can increase the load carrying capacity of longitudinal load carrying members. In the context of the example bridge herein discussed, the system of the present invention produces up to a 30% savings in girder materials, when compared with the prior art of using post-tensioning internal to the deck.

Another significant advantage of the present invention is its flexibility in providing the objects and advantage herein stated, all while accommodating a variety of girder shapes and materials, cast-in-place and match cast deck joints, and span configurations and lengths. In addition to this, the present invention does not require construction equipment not already common to precast bridge deck construction and facilitates rapid bridge construction.

CONCLUSION, RAMIFICATIONS, AND SCOPE

In conclusion, the present invention, through its use of innovative or post-tensioning tendon and deck detailing, provides a bridge construction system that results in an extremely durable, maintainable bridge deck that can also accommodate a variety of bridge configurations and can be rapidly constructed. All this while enhancing the load carrying capacity of the girders, and subsequently reducing required materials for these members.

Although the description above contains many specificities, these should not be construed as limiting the scope of the invention but as merely providing illustrations of some of the presently preferred embodiments of this invention. For example, as illustrated and described herein, the present invention can accommodate a variety of lengths, shapes and materials for the prefabricated deck units, longitudinal load-carrying member and tensioned structural elements.

Thus the scope of the invention should be determined by the appended claims and their legal equivalents, rather than by the examples given.

I claim:

1. A bridge system, comprising:

a) a plurality of prefabricated deck units spaced longitudinally along a bridge, wherein said prefabricated deck units are fully or partially supported by one or more longitudinal load-carrying members, b) a plurality of tensioned structural elements, wherein said tensioned structural elements are external to a minimum of one of said prefabricated deck units, c) means to anchor a plurality of said tensioned structural elements into a plurality of said prefabricated deck units, d) means for transferring tension in said tensioned structural elements into longitudinal axial compression in said prefabricated deck units without shedding said longitudinal axial compression into said longitudinal load-carrying member or members prior to said prefabricated deck units being made composite with said longitudinal load-carrying members.

2. The bridge system of claim 1, wherein the at least one load-carrying member is comprised of any one member or any combination of members selected from the group consisting of steel, concrete and composite materials.

3. The bridge system of claim 1 provides a means to transfer vertical force resulting from a deviation of one or more of said tensioned structural elements in relation to the horizontal plane of said prefabricated deck units, wherein said tensioned structural elements assist said longitudinal load-carrying members in resisting load.

4. The bridge system of claim 1, wherein the prefabricated deck units are produced using a match-casting method.

5. The bridge system of claim 1, wherein the prefabricated deck units are post-tensioning strands or post-tensioning bars or a combination of post-tensioning strands and post-tensioning bars.

6. The bridge system of claim 1, wherein the tensioned structural elements are stressed during any one or more of the following construction stages:

(a) said prefabricated deck units are not composite with any of said longitudinal load-carrying members, (b) said prefabricated deck units are composite with said longitudinal load-carrying members.

7. The bridge system of claim 1, wherein the tensioned structural elements can be lapped, whereby additional deck length can be accommodated.

8. The bridge system of claim 1, wherein replacement of the tensioned structural elements is provided for, thereby enhancing the maintainability and longevity of said bridge.

9. A method for constructing a bridge comprising the steps of:

(a) constructing a plurality of prefabricated deck units, (b) constructing a plurality of supports for the bridge, (c) constructing one or more longitudinal load-carrying members, (d) installing said longitudinal load-carrying member or members, wherein said longitudinal load-carrying member or members are supported by said supports, (e) installing a plurality of tensioned structural elements in conjunction with a means to convert tension in themselves to longitudinal axial compression in said prefabricated deck units, wherein said tensioned elements are external to portions of said prefabricated deck units, (e) installing said prefabricated deck units, wherein said prefabricated deck units are supported by said longitudinal load-carrying member or members and wherein said prefabricated deck units rest on devices that permit relative motion between said prefabricated deck units and said longitudinal load-carrying member or members, (f) after said installation of said prefabricated deck units, stressing of said tensioned structural elements, (g) making said prefabricated deck units composite with said longitudinal load-carrying member or members.

10. The method of claim 9, wherein the at least one load-carrying member is comprised of any one member or any combination of members selected from the group consisting of steel, concrete and composite material.

11. The method of claim 9 includes installing a means to transfer vertical force resulting from a deviation of one or more of said tensioned structural elements in relation to the horizontal plane of said prefabricated deck units, wherein said tensioned structural elements assist said longitudinal load-carrying members in resisting load.

12. The method of claim 9, wherein the prefabricated deck units are produced using a match-casting method.

13. The method of claim 9, wherein the tensioned structural elements are post-tensioning strands or post-tensioning bars or a combination of post-tensioning strands and post-tensioning bars.

14. The method of claim 9, wherein the tensioned structural elements are stressed during any one or more of the following construction stages:

(a) said prefabricated deck units are not composite with any of said longitudinal load-carrying members, (b) said prefabricated deck units are composite with said longitudinal load-carrying members.

15. The method of claim 9, wherein the tensioned structural elements can be lapped, whereby additional deck length can be accommodated.

16. The method of claim 9, wherein replacement of the tensioned structural elements is provided for, thereby enhancing the maintainability and longevity of said bridge.

* * * * *